United States Patent [19]

Alm

[11] Patent Number: 4,621,429

[45] Date of Patent: Nov. 11, 1986

[54] DRAFTING VEHICLE SIMULATOR

[76] Inventor: Gerald F. Alm, Rte. 1, Box 7, Grangeville, Id. 83530

[21] Appl. No.: 761,028

[22] Filed: Jul. 31, 1985

[51] Int. Cl.[4] ..... B43L 13/00

[52] U.S. Cl. ..... 33/18.1; 33/1 SB

[58] Field of Search ..... 33/1 SB, 18 R, 26, 41 R, 33/41 D, 41 E, 45; 346/143

[56] References Cited

U.S. PATENT DOCUMENTS

| | | | |
|---|---|---|---|
| 2,028,622 | 1/1936 | Phelps | 33/1 SB |
| 2,179,663 | 11/1939 | Link, Jr. | 33/18 R |
| 2,528,573 | 11/1950 | Beugler | 33/41 R |
| 2,751,273 | 6/1956 | Rankin | 33/18 R |
| 3,726,019 | 4/1973 | Adler | 33/18 R |
| 4,485,555 | 12/1984 | May et al. | 33/18 R |
| 4,528,754 | 7/1985 | Houldsworth | 33/18 R |

FOREIGN PATENT DOCUMENTS

| | | | |
|---|---|---|---|
| 1032487 | 6/1966 | United Kingdom | 33/18 R |

*Primary Examiner*—Richard R. Stearns
*Attorney, Agent, or Firm*—Harvey B. Jacobson

[57] ABSTRACT

A vehicle simulating frame assembly is supported on a track recording surface by pairs of non-dirigible tractor wheels spaced laterally outward of track marking devices plotting parallel spaced track lines on the surface in response to wheeled movement of the frame assembly along a path recorded as a center guide line equally spaced between the track lines. The frame assembly is steered along the path by a dirigible guide wheel aligned with said center guide line and angularly displaceable by means of a steering spindle between angular limits corresponding to the maximum steering cramp angle of the vehicle being simulated.

34 Claims, 18 Drawing Figures

DRAFTING VEHICLE SIMULATOR

BACKGROUND OF THE INVENTION

This invention relates to a system of drafting implements adapted for use by forest road engineers in the analysis of vehicle off-tracking for forest roadway design.

Drafting instruments in the form of wheeled devices having scribers or marking tools moved over a drawing surface to plot lines on such surface, are generally known. However, a system of such wheeled drafting tools capable of being assembled to simulate articulated land vehicles to plot tracking lines as data useful in the analysis and design of forest roadways, are not available or specifically known.

It is therefore an object of the present invention to provide drafting implements capable of being selectively assembled to simulate movement of non-articulated and articulated land vehicles along a desired path on a recording surface to plot data from which off-tracking analysis and road design may be performed in an accurate and rapid manner.

SUMMARY OF THE INVENTION

In accordance with the present invention, a plurality of frame sections are assembled from elongated beams interconnected in perpendicular adjusted relationship to carry non-dirigible traction wheels and track recording marker devices in adjusted positions for plotting parallel spaced tracking lines on a road simulating surface or drafting paper. Each of the beams is formed by a pair of solid bars spaced apart in parallel relation to each other by interconnecting brackets, the traction wheel assemblies, the marker devices and by pivotal ball and socket coupling devices through which the frame sections may be selectively interconnected.

One of the frame sections includes two axle beams interconnected with a wheel base beam to form the frame of a tricycle steering unit for an articulated assembly of frame sections simulating a land vehicle. A pair of the non-dirigible traction wheels are carried on one of the axle beams spaced by an adjusted wheel base distance from the other axle beam carrying a dirigible wheel assembly. A central guide path line is recorded by a yarder tower marker device mounted on the wheel base beam forwardly of the dirigible wheel assembly. The dirigible wheel assembly is angularly displaceable about a single steering axis intersecting the axle beam and wheel base beam by a steering spindle between angular limits. The angular limits are adjustably set on a cramp angle indicator plate so as to correspond to the maximum cramp angles of the steering system of the vehicle being simulated.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
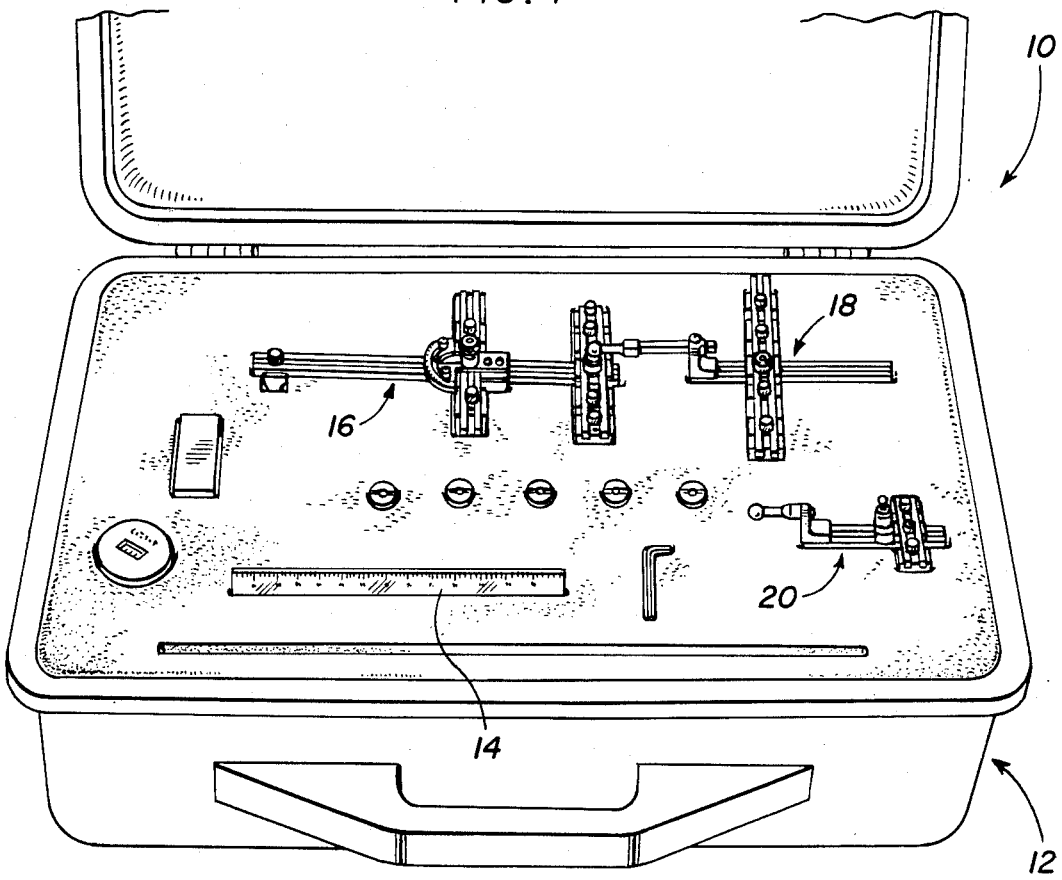
FIG. 1 is a perspective view of an opened carrying case storing components of a vehicle tracking simulator in accordance with one embodiment of the invention.

Referring now to the drawings in detail, FIG. 1 illustrates a drafting vehicle simulator tool kit in accordance with one embodiment of the invention, generally referred to by reference numeral 10. The tool kit includes a typical carrying case 12 within which kit components are stored, including conventional drafting implements such as a transparent plastic engineer's scale 14 and various vehicle simulating components such as a steering frame section 16 and two trailer frame sections 18 and 20.

Figure 2:
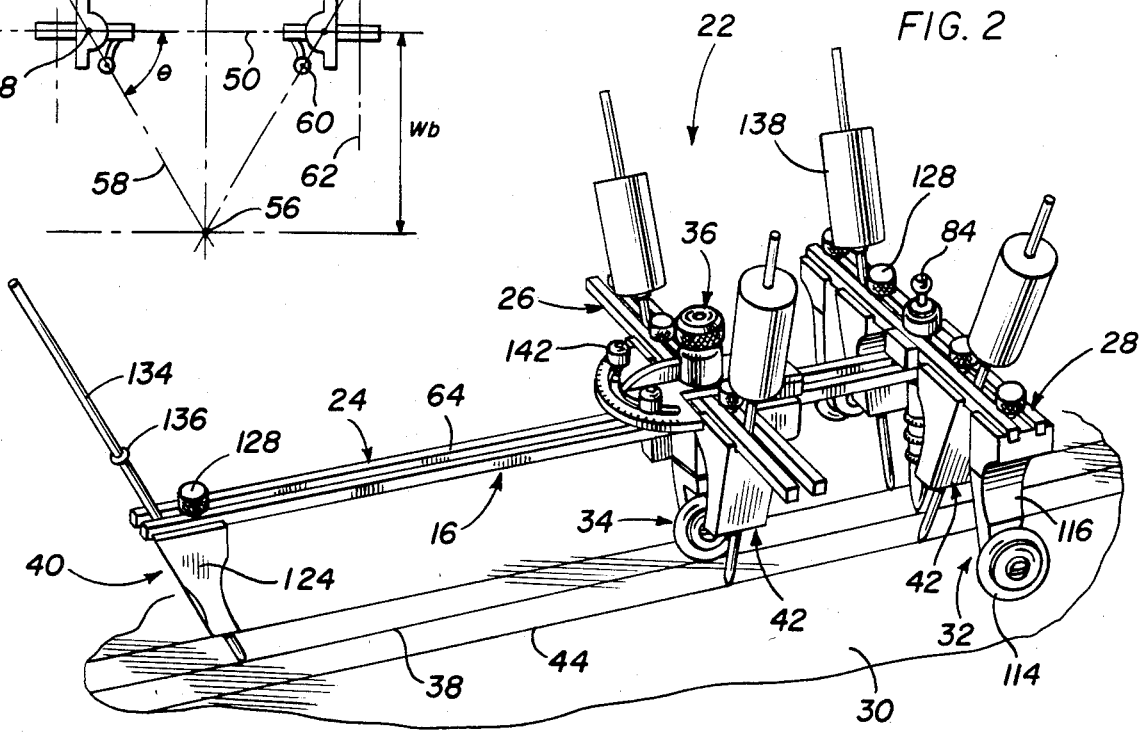
FIG. 2 is a perspective view of a tricycle steering unit assembled from components of the vehicle tracking simulator and supported on a road simulating, track recording surface.

The steering frame section 16 forms part of a basic tricycle steering unit generally referred to by reference numeral 22 shown in FIG. 2 in a fully assembled state. The frame section 16 is a rigid assembly of an elongated, wheel base simulating beam 24 and two axle simulating beams 26 and 28 interconnected therewith at right angles thereto. The assembled frame section is shown supported on a ground or road simulating surface of a tracing or hard shell drafting paper 30 by means of two non-dirigible wheel assemblies 32 and a single dirigible wheel assembly 34. The dirigible wheel assembly is angularly displaceable about a vertical steering axis by means of a simulated steering arrangement, generally referred to by reference numeral 36, mounted on the axle beam 26 and wheel base beam 24 through which the steering axis extends in perpendicular intersecting relation. The dirigible wheel assembly 34 is thereby centrally aligned with a center path line 38 recorded on the surface of paper 30 by a yarder tower marker device 40 adjustably mounted on the wheel base beam 24 in forwardly spaced relation to the axle beam 26. The two non-dirigible wheel assemblies 32 are mounted in laterally spaced relation to the wheel base beam 24 on the axle beam 28 which is rearwardly spaced from the axle beam 26 a distance adjusted to be proportional to the wheel base length of a vehicle being simulated. A pair of track marker devices 42 are mounted on each axle beam in adjusted laterally spaced relation to the wheel base beam 24 so as to record or plot a pair of simulated tire track lines 44 on the surface of paper 30. The marker devices 42 are adjustably spaced laterally inward of the non-dirigible wheel assemblies 32 so as to record the tracking lines 44 equally spaced from the center path line 38 a distance proportional to one-half of the spacing between the tire tracks of the vehicle being simulated.

Figure 3:
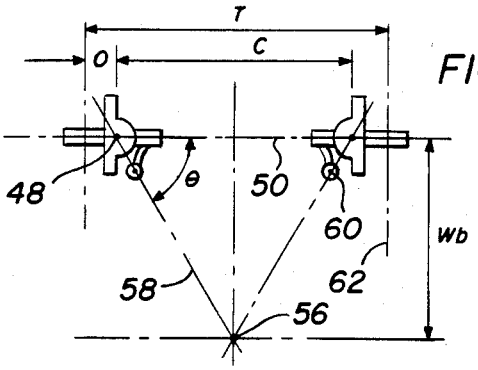
FIG. 3 is a diagram illustrating the geometry of a non-articulated vehicle being simulated by the unit depicted in FIG. 2.

FIG. 3 is a geometric diagram corresponding to the type of non-articulated vehicle steering system to be simulated by the steering unit 22 hereinbefore described with respect to FIG. 2. The diagram of FIG. 3 shows a pair of front wheel mounting members within which a pair of knuckle pivot points 48 are established on a front axle axis 50 perpendicular to and spaced along a frame axis from a fixed rear wheel axis. The frame axis intersects the rear wheel axis at intersection 56 to form an isoceles triangle with the knuckle pivot points 48 having a cross steering lever angle ($\theta$) between the front wheel axis 50 and the legs 58 of the triangle on which the steering lever pins 60 lie. The base of the triangle or distance (C) between knuckle pivot points 48 is fixed as well as the wheel base distance (Wb) between the front axis 50 and the rear wheel axis. The tired wheels to be mounted on the members 46 produce ground tracks (62) spaced apart a distance (T) as shown which is the sum of the triangle base (C) and the offset distances (O) between the knuckle pivots 48 and the wheel tire centers. Using the scale implement 14, the axle beams 26 and 28 of unit 22 are spaced apart along the wheel base beam 24 a distance proportional to the wheel base length (Wb) of the vehicle being simulated for tracking purposes in accordance with some given reduction scale such as 10 feet equal 1 inch. The track recording marker devices 42 are also adjustable spaced along the axle beams a distance proportional to the track spacing distance (T) under the same reduction scale.

Referring now to FIGS. 2, 4, 5 and 6, each of the beams 24, 26 and 28 are of similar construction, except for length, in that they are formed by a pair of elongated parallel spaced bars 64 made of solid, rectangular cross-sectional metallic stock, such as brass or stainless steel. The bars 64 are fixedly spaced from each other by bracket 66 interconnecting the axle beam 28 and wheel base beam 24 and a bracket 68 associated with the steering arrangement 36 which also interconnect beams 24 and 26. The interconnecting bracket 66 is formed with an upwardly opening channel 70 as more clearly seen in FIG. 7 within which the pair of bars associated with axle beam 28 are slidably received, and a downwardly opening channel 72 within which the bars of beam 24 are slidably received at right angles to the bars of beam 28. The bars of each beam are spaced apart within each channel 70 and 72 by a rib through which an opening 75 extends centrally formed in the bracket member 66. The lower end portion of shank 74 is threadedly connected to an elongated pointer 76. Axially spaced, knurled gripping rims 78 are formed on the pointer 76 to facilitate its threaded mounting onto the shank 74 into abutment at its upper end with the underside of the bars of beam 24 as more clearly seen in FIG. 5, to thereby clamp the bars of beam 24 within channel 72 of the bracket 66. The bars of beam 28 on the other hand are clamped within the channel 70 by a spacer 80 mounted on the shank 74 below a thrust disc 82 fixed to the shank. A fifth wheel pivot coupling ball 84 is fixed to the upper end of shank 74 for purposes to be explained hereinafter.

Figure 8:
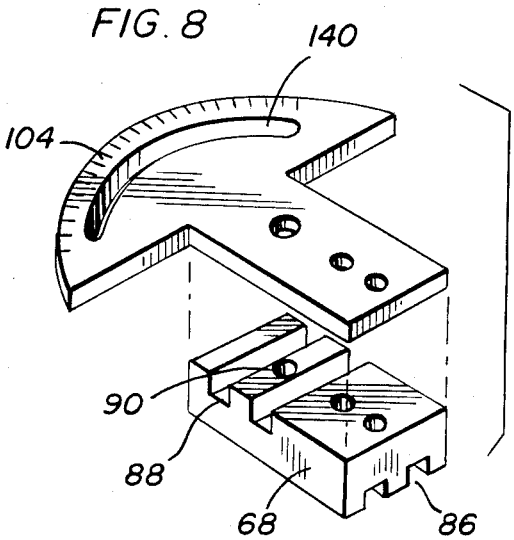
FIG. 8 is a perspective view of the bracket and cramp angle indicator plate associated with the unit shown in FIGS. 2, 5 and 6.

The bars 64 of beam 24 are also clamped in spaced relation to each other within a downwardly opening channel 86 of bracket 68 more clearly seen in FIG. 8. The bracket 68 which is associated with the steering arrangement 36 is also formed with an upwardly opening channel 88 to slidable receive the bars of axle beam 26. An opening 90 is centrally formed through a bar spacing rib in channel 90 to receive a steering spindle 92 connected at its lower end to the dirigible wheel assembly 34 as more clearly seen in FIG. 5. The steering spindle is rotatably mounted in an aligned opening formed in a clamp body 94 having an upwardly opening channel slidably receiving the bars of beam 24 in confronting relation to the downwardly opening channel 86 of bracket member 68. A pair of screw fasteners 96 extend through a pair of openings formed in bracket members 68 for threaded connection to the clamp body 94. The fasteners 96 will thereby releasably hold the steering arrangement 36 in an adjusted position on the beam 24 with its bars 64 clamped between the bracket member 68 and clamp body 94.

Figure 5:
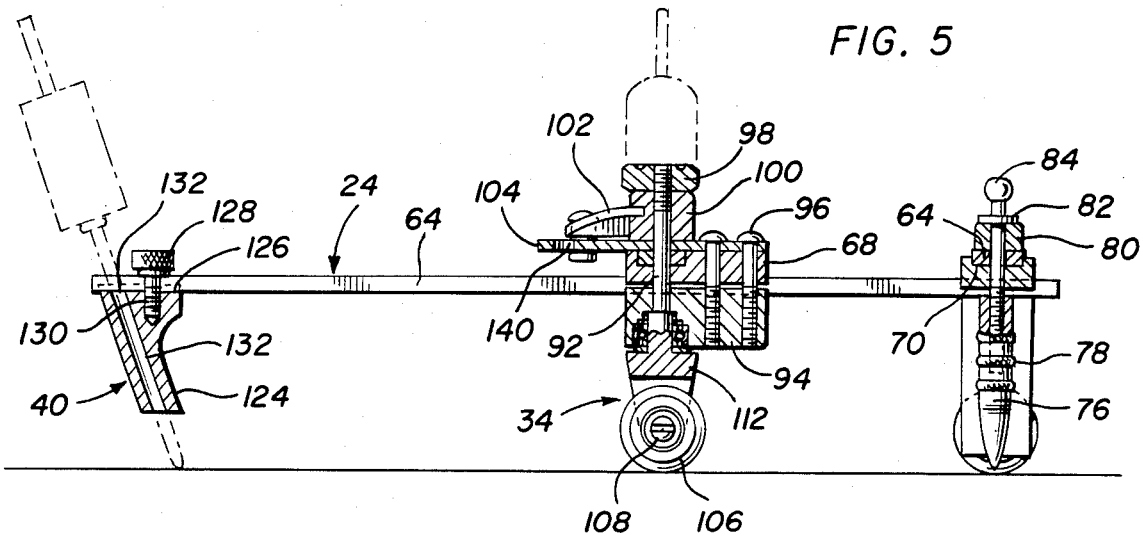
FIGS. 5 and 6 are sectional views taken substantially through planes indicated by section lines 5—5 and 6—6 in FIG. 4.

The bars 64 of beam 24 will also be spaced apart by the steering spindle 92, the upper end of which is threadedly received in a lock nut 98 for holding a collar 100 clamped in an angularly adjusted position against the spaced bars 64 of the axle beam 26 slidably received in the upwardly opening channel 88 of bracket member 68 as more clearly seen in FIG. 5. The collar 100 is rotationally fixed to the steering spindle 92 and has a pointer 102 projecting therefrom in overlying relation to an arcuate indicator plate extension 104 on the bracket member 68. The indicator plate extension may be provided on its upper surface with angle indicia along an arc having its center on the vertical spindle axis through the steering spindle 92. A guide wheel 106 of the dirigible wheel assembly 34 is aligned with pointer 102 in a vertical plane intersecting the steering spindle axis. The guide wheel is accordingly mounted on a pin 108 having an axis intersecting said vertical Plane at right angles. The wheel pin 108 is carried by a laterally depending arm 110 of a wheel mounting body 112 to which the lower end of spindle 92 is connected as more clearly seen in FIG. 6.

Figure 9:
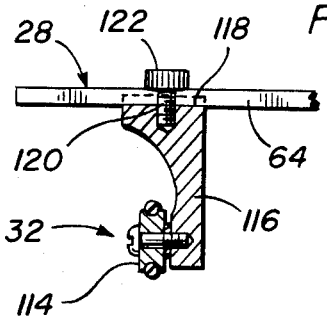
FIG. 9 is a sectional view of a non-dirigible wheel assembly, taken substantially through a plane indicated by section line 9—9 in FIG. 4.

By loosening and tightening the nut 98 of the steering arrangement 36, the guide wheel 106 may be positioned for wheeled movement of the steering unit 22 along a path 38 of any desired curvature as recorded on surface 30. Wheeled support for unit 22 is provided for by the guide wheel 106 of the dirigible wheel assembly 34 and the two non-dirigible wheel assemblies 32, each of which includes a traction wheel 114 rotatably carried by a wheel mounting body 116. The upper end of each wheel mounting body 116, as more clearly seen in FIG. 9, has an upwardly opening channel 118 slidably receiving the bars 64 of axle beam 28. A fastener 120 is threadedly mounted in the body 116 and extends upwardly through the channel 118 to space the bars 64 of axle beam 28. A knurled head portion 122 of the fastener 120 bridges the bars and is adapted to clamp them to the wheel mounting body 116 to releasably hold the wheel assembly 32 in an adjusted position on the axle beam 28 laterally spaced from the wheel base beam 24.

Figure 6:
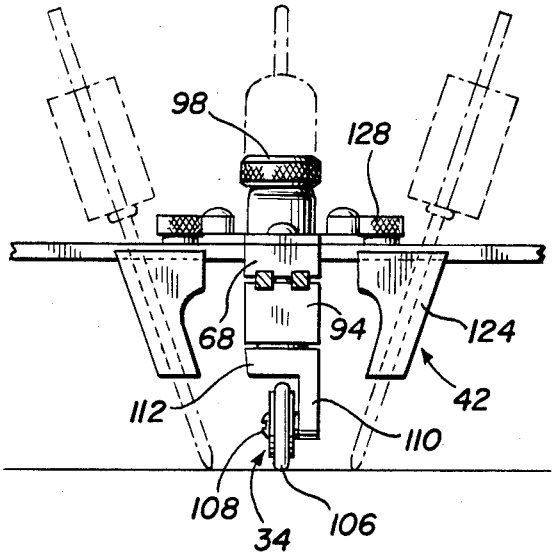
Figure 7:
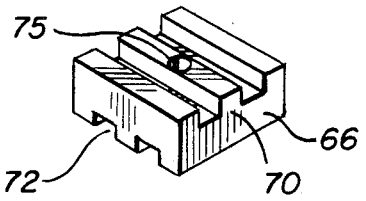
FIG. 7 is a perspective view of an interconnecting bracket utilized in the unit illustrated in FIGS. 2, 5 and 6.

Each of the marker devices 40 and 42 as more clearly seen in FIGS. 5 and 6, includes an elongated marker holding body 124 having an upwardly opening channel 126 slidably receiving the pair of bars of the beam to which it is clamped in an adjusted position by the knurled head portion 128 of a threaded fastener 130. The body 124 depends generally at angle from its beam 24, 26 or 28 and is provided with a slide bore 132 at an angle to the longitudinal axis of the beam. The upper end of the bore 132 opens within the channel 126 between the bars 64 of the beam for slidably receiving an elongated marking pin 134. Accordingly, pen 134 when inserted into a bore of a marker holding body 124, will contact the surface of paper 30 as shown in FIG. 2. A stop element 136 is mounted on each marker pen above the beam so as to support a cylindrical weight 138. The pen will therefore contact the recording surface under sufficient pressure to record the path 38 and tracks 44 aforementioned.

Figure 4:
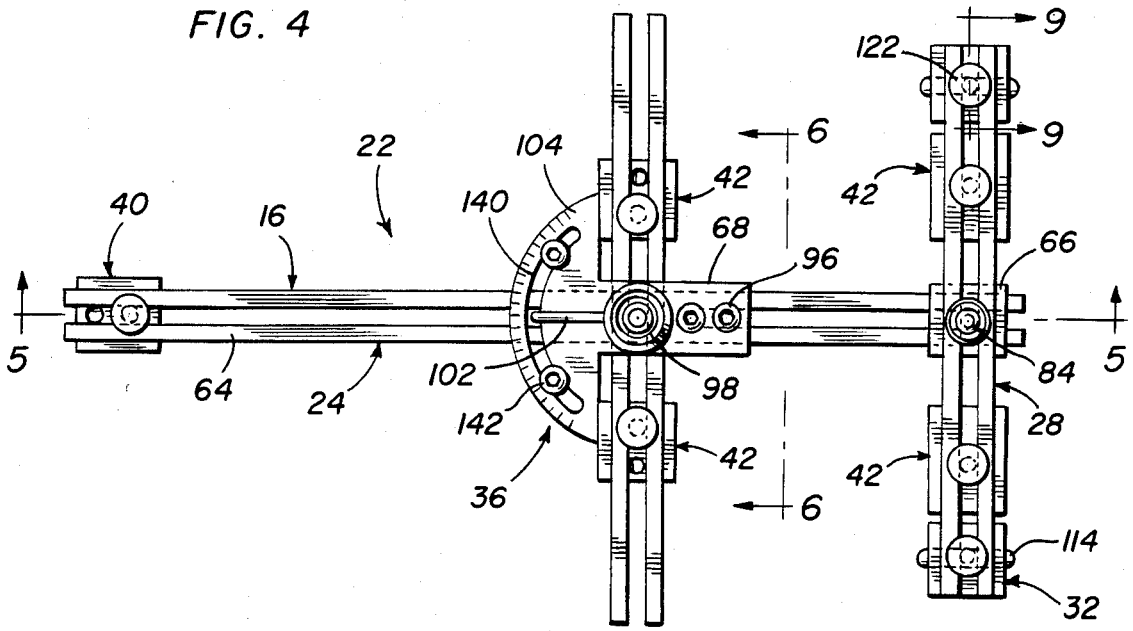
FIG. 4 is a top plan view of the unit shown in FIG. 2.
Figure 10:
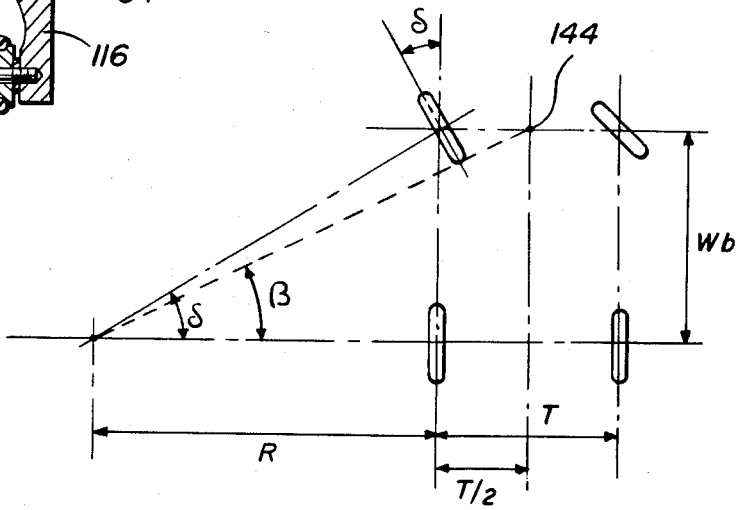
FIG. 10 is a diagram illustrating the angular limiting geometry of the steering arrangement associated with the unit shown in FIGS. 2, 5 and 6.

Referring once again to the steering arrangement 36 as shown in FIGS. 2 and 4, the indicator plate extension 104 is provided with an arcuate slot 140 within which a pair of adjustable limit stop elements 142 are slidably secured. When locked in adjusted position in slot 140, the stop elements will limit the angular adjustment of pointer 102 and steering spindle 92 connected thereto, since pointer 102 closely overlies the slot 140 from which the limit stops 142 project. The limit stops 142 are adjusted to positions of simulated maximum cramp angles ($\beta$) from a zero angle aligned with the longitudinal axis of beam 24. As diagrammed in FIG. 10, the angle ($\beta$) corresponds to the actual maximum cramp angle ($\delta$) of the steering system in the vehicle being simulated. As shown, the simulated maximum cramp angle ($\beta$) is the angle between the hypotenuse of a right triangle and one leg thereof equal to one-half of the wheel spacing (T) of the vehicle and a distance (R), wherein the length of the other perpendicular leg is equal to the wheel base length (Wb). The distance (R) is equal to one leg of a right triangle having its other leg equal to (Wb) and a maximum cramp angle ($\delta$) between the leg (R) and the hypotenuse. From the geometry shown in FIG. 10, the simulated maxinum cramp angle ($\beta$) may be determined from the mathemetical expression:

$$\beta = \tan^{-1}\left[\frac{Wb}{R + T/2}\right]$$

The simulated maximum cramp angle ($\beta$) must be computed to set the limit positions of stops 142 for unit 22 because of the location of its single simulated steering axis 144 as compared to the arrangement associated with the actual steering system of the vehicle being simulated. The angle indicia inscribed on the indicator plate extension 104 will enable setting of the limit stops 142 after the limit angle ($\beta$) is computed. The proportional wheel base distance between the axle beams 26 and 28 is also adjusted for the assembled steering unit 22 and the wheel assemblies 32 are set equal distances from the wheel base beam 24. The tire tracking width between marker devices 42 is then set to scale after centering the marker device 40 and pointer 76 on a straight plotted line portion of the path 38 on paper 30.

Figure 13:
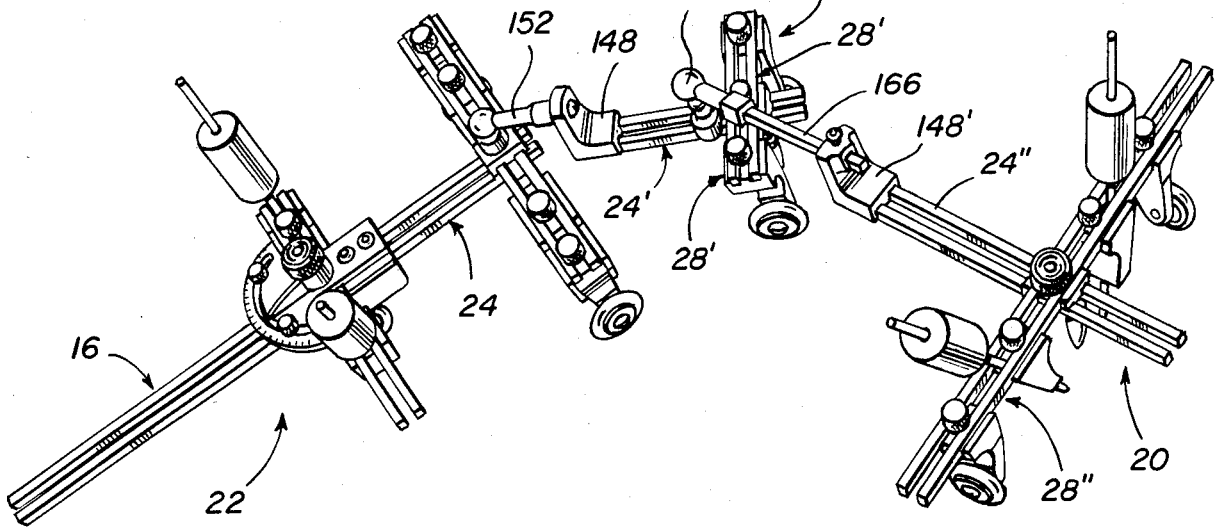
FIGS. 11, 12 and 13 are perspective views of different articulated vehicle configurations assembly from the components of the present invention.
Figure 12:
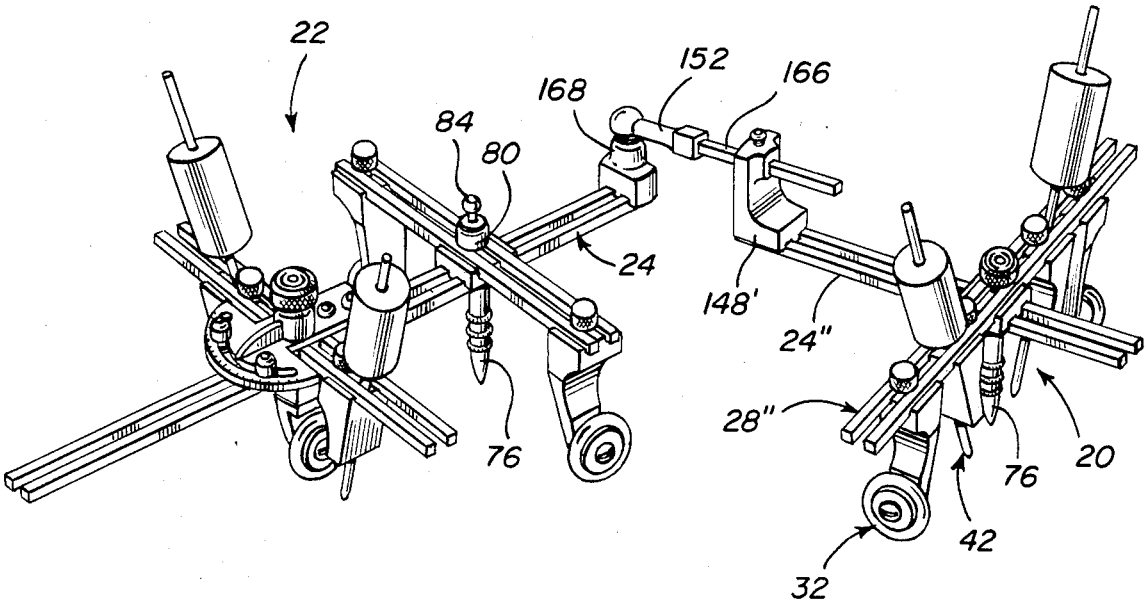
Figure 11:
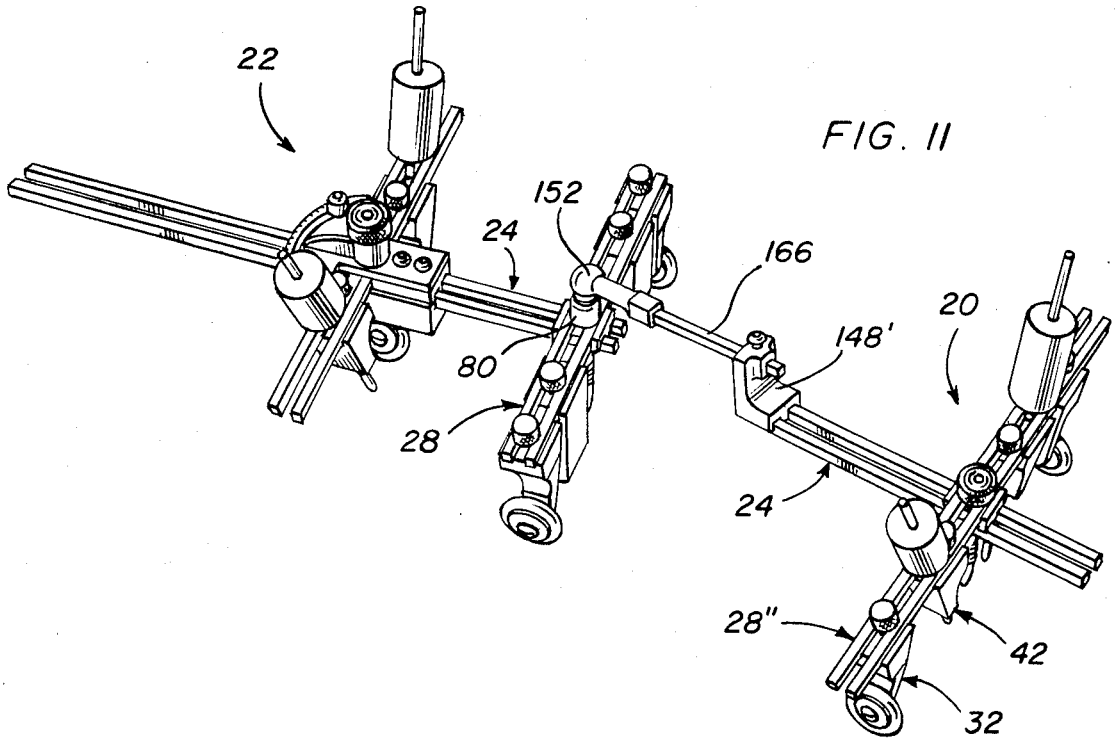

Similar wheel tire spacing adjustment to scale is made on the trailer frame section 20 aforementioned, when coupled to the frame section 16 of the assembled steering unit 22 through the fifth wheel coupling ball 84 to form various articulated vehicle configurations as respectively shown in FIGS. 11, 12 and 13. Thus, each of the trailer frame sections 18 and 20 adjustably mounts a pair of non-dirigible wheel assemblies 32 on its axle beam 28' or 28'' while the trailer frame section 20 also mounts laterally inwardly of its wheel assemblies 32 a pair of track recording marker devices 42. A center pointer 76 is also centrally mounted on the axle beam of each trailer frame section 18 and 20.

Figure 14:
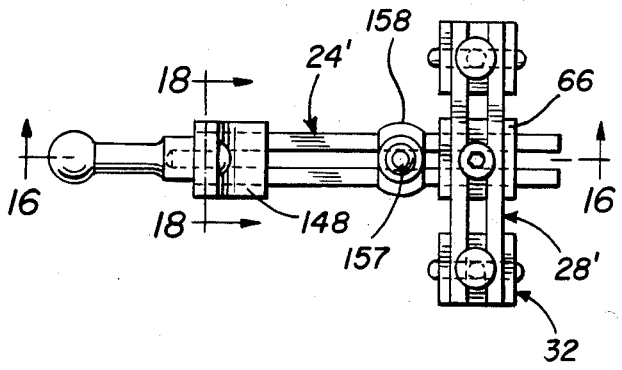
FIGS. 14 and 15 are top plan view of different trailer frame sections utilized in the configuration shown in FIG. 13.
Figure 18:
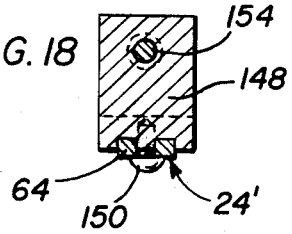
FIG. 18 is a sectional view taken substantially through a plane indicated by section line 18—18 in FIG. 14.
Figure 16:
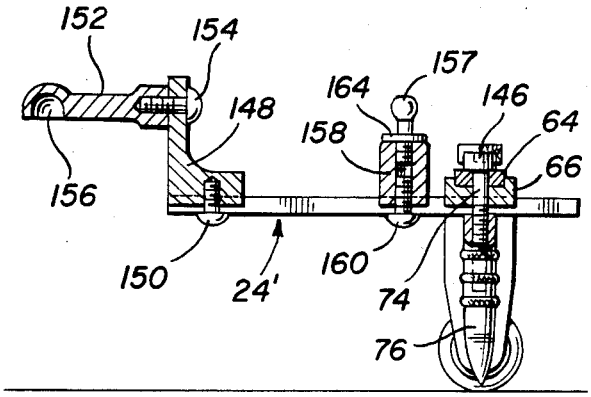
FIGS. 16 and 17 are sectional views taken through planes indicated by section lines 16—16 and 17—17 in FIGS. 14 and 15, respectively.

As more clearly seen in FIGS. 13, 14 and 16, the trailer frame section 18 is assembled from an elongated trailer frame beam 24' and a single axle beam 28' which are shorter in length than beams 24 and 28 but are otherwise identical in construction and interconnected in perpendicular relation to each other by a bracket member 66 as hereinbefore described with respect to the beams 24 and 28 of frame section 16. The axle beam 28' is clamped to the bracket 66 by the head portion 146 of a fastener 74, threadedly connected to the pointer 76. The end of the beam 24' remote from axle beam 28' is slidably received in downwardly opening channels formed at the lower end of a gooseneck bracket 148 as shown in FIG. 18. A screw fastener 150 as shown in FIG. 16 extends between the bars of beam 24' into the bracket 148 to hold the bracket assembled to the beam. A coupling arm 152 is directly connected to the upper end portion of bracket 148 by a screw fastener 154 and extends therefrom generally parallel to the beam 24'. A coupling socket 156 is formed at the end of the coupling arm. A coupling ball 157 is mounted on the beam 24' between the axle beam 28' and bracket 148 by means of a spacer 158. The spacer is connected to the beam 24' by a screw fastener 160 extending between the bars thereof. A threaded shank connects the ball 157 to the spacer and has a thrust disc 164 in abutment with the upper end of the spacer as shown in FIG. 16.

Figure 15:
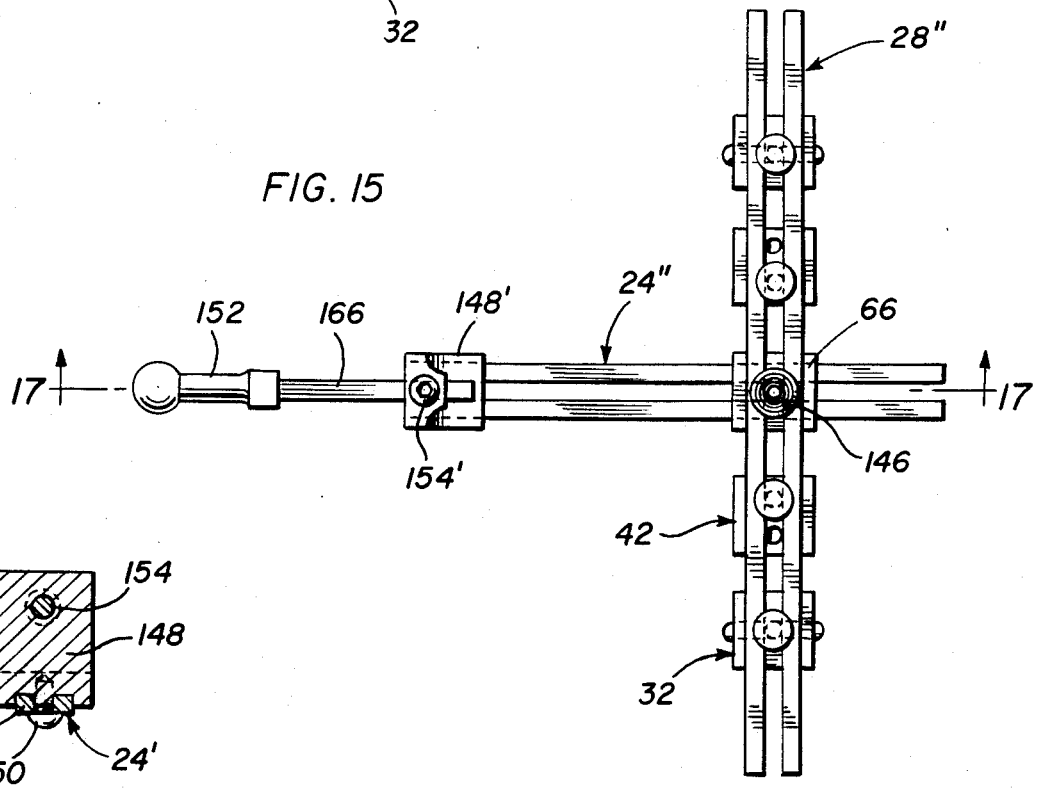
Figure 17:
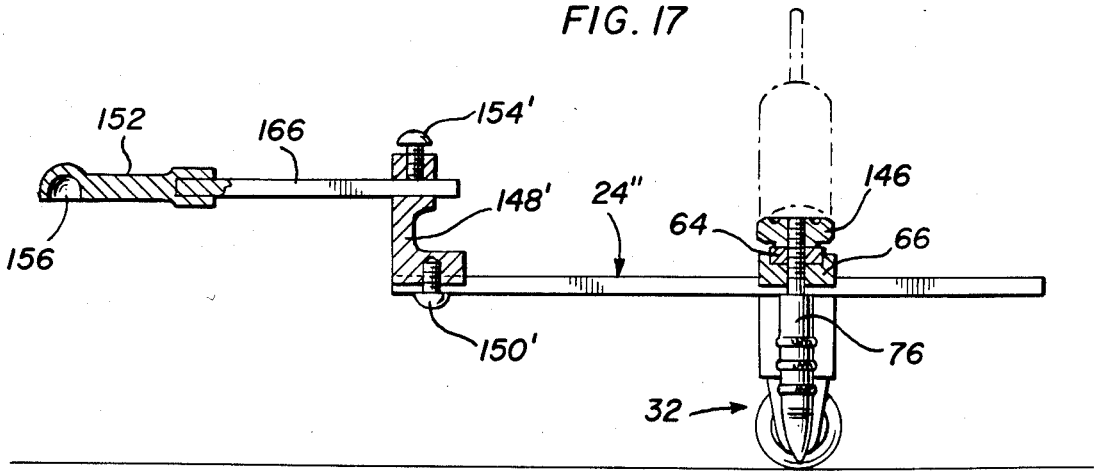

The trailer frame section 20 is similar in construction to the frame section 18 except that its trailer frame beam 24'' is somewhat longer than beam 24' while its somehat large axle beam 28'' carries a pair of track recording marker devices 42 spaced inwardly of the wheel assemblies 32 as shown in FIG. 15. The forward end of the beam 24'' also has a gooseneck bracket 148' secured thereto by a fastener 150'. A screw fastener 154' connects the bracket 148' to an extension rod 166 on which another coupling arm 152 is mounted as more clearly seen in FIG. 17.

The socket 156 of coupling arm 152 receives the coupling ball 84 on the steering unit 22 as hereinbefore described with respect to FIG. 2, in order to pivotally interconnect unit 22 with an assembled trailer frame section 20 to form a simulated tractor-trailer configuration as shown in FIG. 11. When the coupling arm 152 of trailer frame section 20 is hitched to an additional ball coupling 168 secured to the end of beam 24 of the steering unit 22 as shown in FIG. 12, a log truck configuration is formed. In FIG. 13, the coupling arm 152 is hitched to the ball coupling 157 on the trailer frame section 18. The coupling arm 152 of trailer frame section 18 is in turn directly hitched to the ball coupling 84 of the steering unit 22 to form a tractor-jeep-trailer configuration as shown in FIG. 13. Thus, various articulated vehicle configurations are selectively assembled from the frame sections 16, 18 and 20 by snap fitting the ball and socket portion of couplings 82 or 168 and 152.

Once a desired vehicle simulating configuration is assembled, it is wheeled on the surface of paper 30 to simulate tracking of an actual truck being driven on the road, with the unit 22 of the assembly used to steer as a truck driver would under circumstances to be simulated. The tracking of the unit 22 and trailer section 20 will accordingly be plotted or recorded by the marker devices 42 as parallel tracking lines 44 equally spaced from the center path line 38 from which recorded data for curve and vehicle off-tracking analysis may be performed in connection with forest road design. Except for the assembly and adjustment of the various truck configuration hereinbefore described, use off-tracking formulas are replaced by use of the simulator 10 to plot data simulating various road design parameters such as tracking through through compound curves, backup and turning, steering maneuvers, cramp angle and yarder tower tracking.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A drafting device for plotting the tracking of a wheeled vehicle having dirigible and non-dirigible road tracking wheels, said device including a wheel base beam, two axle beams, assembly means for fixedly holging the axle beams adjustably spaced from each other on the wheel base distance proportional to the wheel base length of the vehicle, wheel means mounted on the axle beams for wheeled support of the assembled beams on a road simulating surface, track recording means mounted on at least one of the axle beams for recording parallel vehicle simulating tracks on the surface in response to wheeled movement of the assembled beams on said surface and means responsive to said wheeled movement for recording a guide path on the surface equally spaced between said parallel vehicle simulating tracks.

2. The drafting device as defined in claim 1 including simulation steering means operatively mounted on one of the axle beams for angular adjustment of the associated wheel means about a steering axis extending in perpendicular intersecting relation to the wheel base beam.

3. The drafting device as defined in claim 2 wherein said wheel means includes a single dirigible guide wheel, a pair of fixed axle wheels and means mounting said pair of axle wheels on the other of the axle beams laterally outward of the track recording means, said simulation steering means including a steering spindle through which the steering axis extends, means for rotatably mounting the steering spindle on said one of the axle beams and adjustment means operatively connected to the steering spindle for angularly positioning the dirigible guide wheel between angular limits corresponding to maximum steering cramp angles of the vehicle.

4. The drafting device as defined in claim 3 wherein each of said angular limits ($\beta$) is a function of the wheel base length of the vehicle (Wb) and the tire track spacing of the vehicle (T), in accordance with the mathematical expression:

$$\beta = \tan^{-1}\left[\frac{Wb}{R + T/2}\right],$$

where (R) is one leg of a right triangle having another perpendicular leg equal to the wheel base length (Wb) and a hypotenuse forming an angle with said one leg equal to the maximum cramp angle of the vehicle.

5. The drafting device as defined in claim 4 wherein each of said beams is formed by a pair of elongated bars between which the recording means and the steering spindle project into contact with the road simulating surface.

6. The drafting device as defined in claim 5 wherein said guide path recording means is mounted on the wheel base beam spaced from the axle beams.

7. The drafting device as defined in claim 6 including a guide pointer and means mounting the pointer on the other of the axle beams for alignment with the guide path.

8. The drafting device as defined in claim 7 including at least one additonal axle beam and an auxiliary trailer beam connected thereto in perpendicular relation, and coupling means for pivotally connecting the auxiliary trailer beam to the wheel base beam in spaced relation to said other of the axle beams.

9. The drafting device as defined in claim 1 including at least one additional axle beam and an auxiliary trailer beam connected thereto in perpendicular relation, and coupling means for pivotally connecting the auxiliary trailer beam to the wheel base beam in spaced relation to said other of the axle beams.

10. The drafting device as defined in claim 1 wherein each of said beams is formed by a pair of elongated bars between which the recording means project into contact with the road simulating surface.

11. The drafting device as defined in claim 1 wherein said guide path recording means is mounted on the wheel base beam spaced from the axle beams, a guide pointer and means mounting the pointer on the other of the axle beams for alignment with the guide path.

12. In a drafting device having a vehicle simulating frame, wheel means mounted on the frame for support thereof above a road simulating surface and means for recording a path of movement of the frame along said surface, the improvement comprising simulation steering means operatively connected to the frame for angular displacement of the wheel means about a single steering axis extending in perpendicular intersecting relation to the frame, said wheel means including a dirigible wheel operatively connected to the simulation steering means and a pair of tracking wheels mounted on the frame in longitudinally spaced relation to the dirigible wheel, said recording means including track recorder means mounted on the frame for recording parallel spaced tracking lines on the surface during movement of the frame and path recorder means mounted on the frame for recording a path center line on the surface equally spaced between said tracking lines along which the dirigible wheel is in rolling contact with the surface.

13. The improvement as defined in claim 12 wherein the vehicle simulating frame includes a rigid dirigible frame section on which said dirigible wheel and said pair of tracking wheels are adjustably mounted.

14. The improvement as defined in claim 13 wherein the vehicle simulating frame further includes at least one rigid trailer frame section, an additional pair of tracking wheels mounted on the trailer frame section and coupling means pivotally interconnecting said frame sections.

15. The improvement as defined in claim 14 wherein each of said frame sections includes a wheel base simulating beam, at least one axle simulating beam and means interconnecting said beams at right angles to each other.

16. The improvement as defined in claim 15 wherein each of said beams comprises a pair of bars fixedly spaced in parallel relation to each other by said beam interconnecting means.

17. The improvement as defined in claim 16 wherein said beam interconnecting means includes a bracket member having a pair of channels formed therein extending in perpendicular relation to each other, each of said channels slidably receiving one of said beams therein, and releasable means extending through both of said channels between the spaced bars of the beams received therein for locking the beams in adjusted relative positions.

18. The improvement as defined in claim 17 wherein the simulation steering means includes a steering spindle connected to the dirigible wheel and means operatively mounting the steering spindle on the dirigible frame section for angular adjustment of the dirigible wheel between simulated maximum cramp angle limits.

19. The improvement as defined in claim 18 wherein the steering spindle mounting means is operatively connected to said means interconnecting the wheel base simulating beam and said one axle simulating beam of the dirigible frame section.

20. The improvement as defined in claim 19 wherein the dirigible frame section includes a second axle simulating beam interconnected with the wheel base simulating beam in perpendicular relation thereto, said first mentioned pair of tracking wheels being mounted on the second axle simulating beam in laterally spaced relation to the wheel base simulating beam of the dirigible frame section.

21. The improvement as defined in claim 13 wherein the simulation steering means includes a steering spindle connected to the dirigible wheel and means operatively mounting the steering spindle on the dirigible frame section for angular adjustment of the dirigible wheel between simulated maximum cramp angle limits.

22. The improvement as defined in claim 21 wherein the frame section includes a wheel base simulating beam, at least one axle simulating beam and means interconnecting said beams at right angles to each other.

23. The improvement as defined in claim 22 wherein the steering spindle mounting means is operatively connected to said means interconnecting the wheel base simulating beam and said one axle simulating beam of the dirigible frame section.

24. The improvement as defined in claim 23 wherein the dirigible frame section includes a second axle simulating beam interconnected with the wheel base simulating beam in perpendicular relation thereto, said pair of tracking wheels being mounted on the second axle simulating beam in laterally spaced relation to the wheel base simulating beam of the dirigible frame section.

25. The improvement as ddfined in claim 12 wherein the vehicle simulating frame includes a wheel base simulating beam, at least one axle simulating beam and means interconnecting said beams at right angles to each other.

26. The improvement as defined in claim 25 wherein each of said beams comprises a pair of bars fixedly spaced in parallel relation to each other by said beam interconnecting means.

27. The improvement as defined in claim 26 wherein said beam interconnecting means includes a bracket member having a pair of channels formed therein extending in perpendicular relation to each other, each of said channels slidably receiving one of said beams therein, and releasable means extending through both of said channels between the spaced bars of the beams received therein for locking the beams in adjusted relative positions.

28. In a drafting device having a vehicle simulating frame, wheel means mounted on the frame for support thereof above a ground simulating surface and means for recording a path of movement of the frame along said surface, the improvement residing in said frame including a wheel base simulating beam, at least one axle simulating beam and means interconnecting said beams at right angles to each other, each of said beams comprising a pair of bars fixedly spaced in parallel relation to each other by said beam interconnecting means, said recording means and the wheel means being mounted on the axle simulating beam.

29. The improvement as defined in claim 28 wherein said beam interconnecting means includes a bracket member having a pair of channels formed therein extending in perpendicular relation to each other, each of said channels slidably receiving one of said beams therein, and releasable means extending through both of said channels between the spaced bars of the beams received therein for locking the beams in adjusted relative positions.

30. In a drafting device for plotting, on a ground simulating surface, movement of a wheeled vehicle having front and rear axles longitudinally spaced from each other by a wheel base distance (Wb), said device including a vehicle simulating frame through which a longitudinal axis extends, wheel means mounted on said frame for wheeled support thereof on the ground simulating surface and means responsive to wheeled movement of the frame on said surface for recording a path of movement thereon, the improvement residing in said wheel means including a dirigible wheel and a pair of non-dirigible wheels mounted on the frame in laterally spaced relation to said longitudinal axis, simulation steering means mounted on the frame and connected to said dirigible wheel for angular displacement thereof about a steering axis extending in perpendicular intersecting relation to the longitudinal axis of the frame and additional means mounted on the frame in spaced relation to the wheel means and responsive to wheeled movement of the frame on said ground simulating surface for recording a path line thereon along which the dirigible wheel is in rolling contact between said non-dirigible wheels.

31. In a drafting device for plotting, on a ground simulating surface, movement of a wheeled vehicle having front and rear axles longitudinally spaced from each other by a wheel base distance (Wb), said device including a vehicle simulating frame through which a longitudinal axis extends, wheel means mounted on said frame for wheeled support thereof on the ground simulating surface and means responsive to wheeled movement of the frame on said surface for recording a path of movement thereon, the improvement residing in said wheel means including a dirigible wheel and a pair of non-dirigible wheels mounted on the frame in laterally spaced relation to said longitudinal axis, simulation steering means mounted on the frame and connected to said dirigible wheel for angular displacement thereof about a steering axis extending in perpendicular intersecting relation to the longitudinal axis of the frame and means for limiting said angular displacement of the dirigible wheel about the steering axis to a simulated maximum steering cramp angle ($\beta$), where $$\beta = \tan^{-1}\left[\frac{Wb}{R + T/2}\right]$$

and wherein (T) is the tire track width of the vehicle and (R) is one leg of a right triangle having another perpendicular leg equal to the wheel base distance (Wb) and a hypotenuse forming an angle with said one leg equal to the maximum cramp angle of the vehicle.

32. The improvement as defined in claim 31 wherein said recording means records parallel spaced tracks on the surface equally spaced from the recorded path by a distance substantially proportional to one-half of the tire track width (T/2) of the vehicle.

33. The improvement as defined in claim 32 including axle simulating means connected to the frame for mounting said pair of non-dirigible wheels a distance from the dirigible wheel along the longitudinal axis proportional to the wheel base distance (Wb) of the vehicle.

34. In a drafting device for plotting, on a ground simulating surface, movement of a wheeled vehicle having fron and rear axles longitudinally spaced from each other by a wheel base distance (Wb), said device including a vehicle simulating frame through which a longitudinal axis extends, wheel means mounted on said frame for wheeled support thereof on the ground simulating surface and means responsive to wheeled movement of the frame on said surface for recording a path of movement thereon, the improvement residing in siad wheel means including a dirigible wheel and a pair of non-dirigible wheels mounted on the frame in laterally spaced relation to said longitudinal axis, simulation steering means mounted on the frame and connected to said dirigible wheel for angular displacement thereof about a steering axis extending in perpendicular intersecting relation to the longitudinal axis of the frame and axle simulating means connected to the frame for mounting said pair of non-dirigible wheels a distance from the dirigible wheel along the longitudinal axis proportional to the wheel distance (Wb) of the vehicle.

* * * * *